United States Patent [19]

Tsukakoshi

[11] Patent Number: 4,623,210

[45] Date of Patent: Nov. 18, 1986

[54] LATCHING MEANS FOR ELECTRICAL CONNECTORS

[75] Inventor: Masao Tsukakoshi, Tokyo, Japan

[73] Assignee: AMP Incorporated, Harrisburg, Pa.

[21] Appl. No.: 792,226

[22] Filed: Oct. 25, 1985

Related U.S. Application Data

[63] Continuation of Ser. No. 592,487, Mar. 23, 1984, abandoned.

[30] Foreign Application Priority Data

Apr. 28, 1983 [JP] Japan ..... 58-062968

[51] Int. Cl.[4] ..... H01R 13/627

[52] U.S. Cl. ..... 339/91 R

[58] Field of Search ..... 339/91 R

[56] References Cited

U.S. PATENT DOCUMENTS

| | | | |
|---|---|---|---|
| 3,178,674 | 4/1965 | Scheller | 339/91 R |
| 3,501,736 | 3/1970 | Norris | 339/91 R |
| 3,530,424 | 9/1970 | Gregory | 339/91 R |
| 4,070,080 | 1/1978 | Eshleman et al. | 339/91 R |
| 4,272,145 | 6/1981 | La Duke | 339/91 R |
| 4,370,013 | 1/1983 | Niitsu et al. | 339/91 R |
| 4,418,975 | 12/1983 | O'Keefe | 339/91 R |
| 4,420,209 | 12/1983 | Reis et al. | 339/91 R |
| 4,455,056 | 6/1984 | Herrmann, Jr. et al. | 339/91 R |

*Primary Examiner*—John McQuade

*Attorney, Agent, or Firm*—Adrian J. LaRue; Bruce J. Wolstoncroft

[57] ABSTRACT

An electrical connector assembly comprises matable male and female housing members including latching members for latching the housing members together. One of the housing members is provided on an outer surface with a flexible latching arm extending in the direction of the other of the housing members and includes a hole near the end that is integral with the housing member. A latching section is provided on an outer surface of the other of the housing members and engages an upper surface of the latching arm when a latching projection of the latching section is latchably disposed in the hole of the latching arm thereby latching the mated housing members together.

7 Claims, 4 Drawing Figures

LATCHING MEANS FOR ELECTRICAL CONNECTORS

This application is a continuation of application Ser. No. 592,487, filed Mar. 23, 1984, now abandoned.

FIELD OF THE INVENTION

The invention relates to electrical connectors and more particularly to a latching means for electrical connectors.

BACKGROUND OF THE INVENTION

It is known to provide an electrical connector with a latching means that comprises a male housing and a female housing which are matable with each other, the male housing having a latching arm which is provided with a latching projection, the latching arm being fixed to the front end of the outer wall of the male housing at its one end and extending rearward with a small inclination angle to the outer wall surface, the female housing being provided with a latching section which engages the latching projection of the latching arm to latch the two housings together when the female housing is mated with the male housing.

An advantage of such latching means lies in that the engagement of the latching projection with the latching section can be released by simply depressing downward the free end of the latching arm when removing the male housing from the female housing. However, in this latching means, the latching arm provided on the male housing must have a fixed end latching projection and depressing portion for its necessary construction, and the latching projection must be spaced apart from the fixed end and the depressing portion with an adequate distance respectively therebetween. But the latching arm of a connector, in which the mating of the male housing into the female housing is shallow, cannot be long enough in the direction of mating to meet the above-mentioned requirement thereby rendering a latching means of this type not applicable.

Moreover, in this latching means, the latching arm is provided on the male housing projecting outwardly from the outer wall surface thereof; thus, extra space is needed in the female housing for incorporating the latching arm thereby prohibiting the connector from being smaller.

SUMMARY OF THE INVENTION

The invention was made with regard to the above-mentioned problem and makes it an object to provide matable male and female housing members of a connector housing assembly which are equipped with latching means which can be arranged in a small space to latchably maintain male and female housing members matably together at the same time permit release of the housing members by a simple operation.

An electrical connector assembly comprises matable male and female housing members including latching members for latching the housing members together. One of the housing members is provided on an outer surface with a flexible latching arm extending in the direction of the other of the housing members and includes a hole near the end that is integral with the housing member. A latching section is provided on an outer surface of the other of the housing members and engages an upper surface of the latching arm when a latching projection of a latching section is latchably disposed in the hole of the latching arm thereby latching the mated housing members together.

DETAILED DESCRIPTION OF THE INVENTION

According to the invention, an electrical connector housing assembly 10 comprises a female housing 10*a* and a male housing 10*b* which fits in, and therefore mates with, the female housing 10*a*, both housings being formed from a suitable dielectric plastic material.

Figure 1:
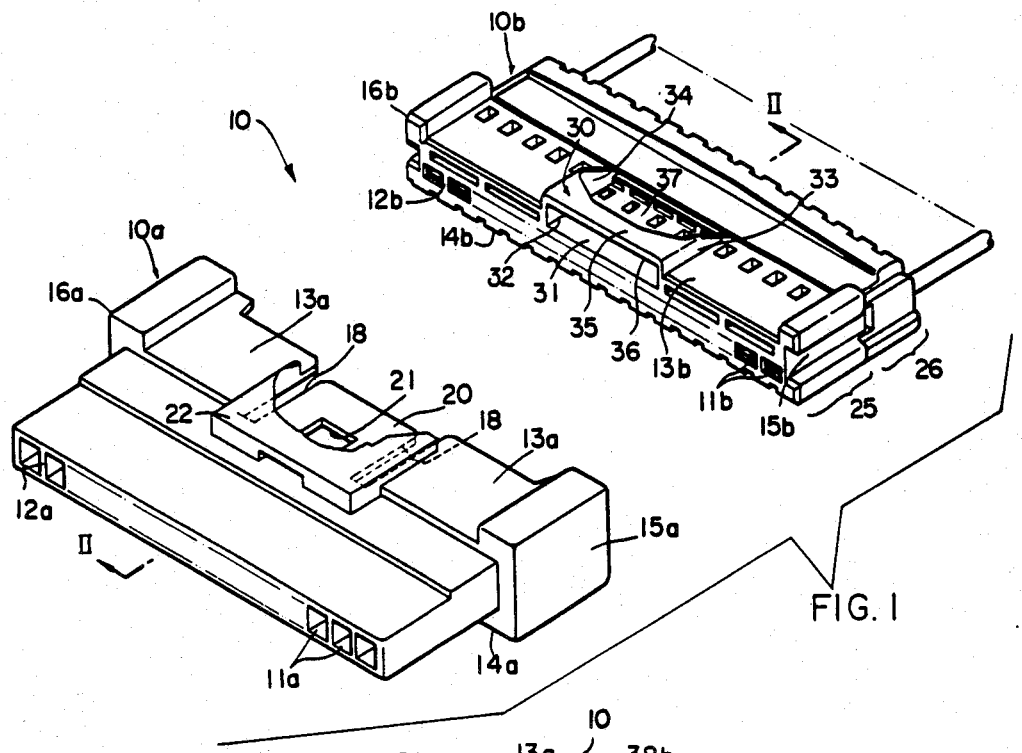
FIG. 1 is a perspective view of electrical connector housings according to the invention before they are assembled.
Figure 2:
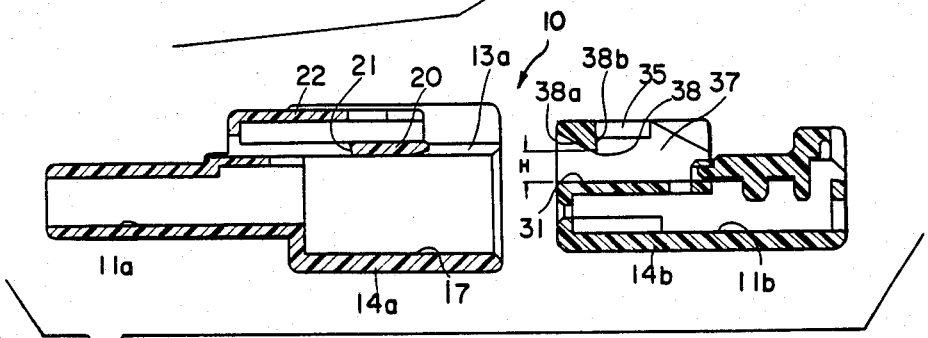
FIG. 2 is a cross section taken along line II—II of FIG. 1.
Figure 3:
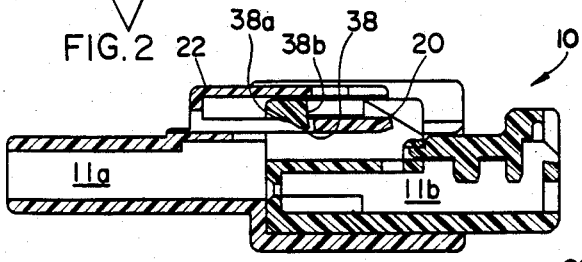
FIG. 3 is a cross-sectional view similar to FIG. 2 in the assembled condition.

Female housing 10*a* contains a plurality of contact cavities 11*a* separated from each other by walls 12*a*, and further contains a hollow portion 17 (FIG. 2) of generally rectangular section forward of the contact cavities, i.e., on the side of the housing in which male housing 10*b* is to be mated, the hollow portion being defined by an upper wall 13*a*, lower wall 14*a*, and side walls 15*a*, 16*a*.

The central portion of the upper wall 13*a* is provided with a flexible latching arm 20 of tongue shape which is formed in such a way that two sides thereof are cut and separated from the upper wall 13*a* by two slits 18, the latching arm being integral and therefore fixed at one end to the side of the housing where the contact cavities are located but being free at another end. The latching arm 20 is formed to be shorter than the length of the upper wall 13 in the direction of mating and provided with a rectangular latching hole 21 adjacent to the fixed end.

The upper wall 13*a* is also provided with a hood 22 integral therewith to cover a latching hole 21 of the latching arm 20. A portion of the hood 22 is broken away to show latching arm 20. The free end of latching arm 20 is spaced from hood 22 so that an operator can handle it with fingers. The male housing 10*b* contains a forward half 25 which fits in hollow portion 17 of female housing 10*a* and rear half 26 which is to be exposed from female housing 10*a* when mated and and is provided with a plurality of contact cavities 11*b* located respectively with respect to contact cavities 11*a* of female housing 10*a*, the contact cavities 11*b* being separated from each other by walls 12*b* and extending throughout the forward and rear halves.

The forward half 25 of male housing 10*b* contains an upper wall 13*b*, lower wall 14*b*, and side walls 15*b*, 16*b* which engage the inner wall surfaces of hollow portion 17 of female housing 10*a*, the forward portion of the upper wall on the mating side being provided with a latching portion 30 which engages latching arm 20.

Latching portion 30 contains a latching arm-receiving aperture 36 defined by a bottom wall 31 which is located lower than the upper surface of the upper wall 13*b*, a pair of side walls 33, 34 extending upward in parallel from the upper wall 13*b*, a slender latching plate 35 which extends and interconnects the forward portions of the side walls 33, 34.

The rear section of latching plate 35 is provided with an opening 37 to expose the free end of latching arm 20 therefrom when male housing 10*b* has been mated in female housing 10*b*. In the central portion of the underside surface of latching plate 35 is provided a latching projection 38 which is to engage latching hole 21 in latching arm 20 of the female housing, latching projection 38 having an inclined surface 38*a* in the forward end and a vertical surface 38*b* in the rear end, the tip end surface of projection 38 being nearly or generally flush with the upper surface of upper wall 13*b*.

Figure 4:
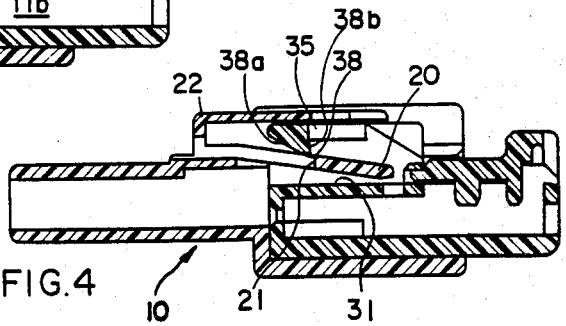
FIG. 4 is a cross-sectional view similar to FIG. 3 but in the condition where the latching arm is being disengaged from the latching portion.

Latching plate 35 is made so as to protrude beyond upper wall 13*b* by such height that the underside surface of latching plate 35 is to engage the upper surface of latching arm 20, and the height of aperture 36, i.e., the distance H between the tip end surface of latching projection 38 and bottom surface 31 is established to permit the free end of latching arm 20 to move far enough to clearly disengage latching hole 21 from latching projection 38 when the free end is pressed downward for disengagement as shown in FIG. 4.

In this construction, when forward half 25 of male housing 10*b* is inserted in hollow portion 17 of female housing 10*a*, the free end of latching arm 20 at first engages forward inclined surface 38*a* of latching projection 38 of male housing 10*b*. When male housing 10*b* is further inserted into hollow portion 17, latching arm 20 is deflected downward along inclined surface 38*a*. When latching projection 38 is disposed within latching hole 21 and latching arm 20 returns to its original position, rear surface 38*b* engages latching arm 20 so that the engagement between the latching arm and the latching projection is accomplished, and at the same time the latching of two housings 10*a* and 10*b* is completed. In the process of mating, the pair of side walls of the latching portion on male housing 10*b* fit into both slits 18 of female housing 10*a* and the free end of latching arm 20 is exposed by the opening in the rear portion of latching plate 35.

To disengage latching arm 20 from latching projection 38, the free end of latching arm 20 exposed by the opening in latching plate 35 is pressed downward to release the engagement between latching hole 21 and the latching projection 38, and at the same time one of the two housings is pulled away from the other, thus the two housings are separated from one another.

As heretofore mentioned, the connector assembly not only permits release of the engagement between the female and male housings by such simple operation as pushing down the free end of the latching arm, but also suits the application of connectors having short length or small connectors because no extra space is needed in the two housings for the latching arm which is provided in the outer wall of the female housing, and further the latching portion to engage the latching arm is being provided on the forward portion of the male housing and constructed to make engagement of the latching hole of the latching arm with the latching projection of the latching portion at a position adjacent the mating surfaces of the two housings so that the latching arm can be made only long enough to extend its free end slightly rearward from the latching portion when the two housings are mated together. The latching arm also does not require a large space in the direction of mating.

I claim:

1. An electrical connector assembly, comprising:

a first dielectric housing member and a second dielectric housing member;

sections of said first and second housing members being matable;

said first housing member having an integral cantilevered latch arm means containing a latching opening and said second housing member having an integral latching section which cooperate to latch the housing members in a latched position when the matable sections are mated together;

an integral hood means on said first housing member having side sections extending from said first housing member and a top section parallel to an upper surface of said first housing member, said hood means covering a portion of said latch arm means which includes said latching opening; and a latching plate of said latching section from which protrudes a latching projection being positioned beyond an upper surface of the second housing member, a bottom surface of said latching section being located such that the height between a top of said latching projection and said bottom surface permits a free end of said latch arm means to move far enough to clearly disengage said latch arm means from said latching projection when the free end of said latch arm means is moved away from said latching projection.

2. An electrical connector assembly as claimed in claim 1, wherein said latching projection includes a forward inclined surface and a rear vertical surface, the tip of the latching projection being generally flush with the upper surface of the first housing member.

3. An electrical connector assembly as claimed in claim 1, wherein said latch arm means is formed by parallel slits in a wall of the first housing member.

4. An electrical connector assembly comprising:

a first dielectric housing and a second dielectric housing;

an integral latching arm on the first housing cut from an upper wall of the first housing and remaining in the same plane as the upper wall;

an integral latching section on the second housing having a latching plate from which protrudes a latching projection, the latching plate extends above an upper surface of the second housing allowing the latching projection and the latching arm to cooperate latching the housings together;

an integral hood on the first housing having side sections extending from the upper surface of the first housing to a top section which is substantially parallel to the upper surface of the first housing, the top section covers a portion of the latching arm; and the latching plate of the latching section and the top section of the hood are positioned adjacent each other in a latched condition thereby protecting the latching arm from unwanted unlatching.

5. An electrical connector assembly as claimed in claim 4, wherein the latching arm has a rectangular latching opening therein.

6. An electrical connector assembly as claimed in claim 4, wherein a bottom surface of the latching section is located such that the height between a tip of the latching projection and the bottom surface permits a free end of the latching arm to move far enough to clearly disengage the latching arm from the latching projection when the free end of the latching arm is moved away from the latching projection.

7. An electrical connector assembly as claimed in claim 4, wherein the latching projection includes a forward inclined surface and a rear vertical surface, the top of the latching projection being generally flush with the upper surface of the first housing.

* * * * *